US006082154A

United States Patent [19]

MacDonald

[11] Patent Number: 6,082,154

[45] Date of Patent: Jul. 4, 2000

[54] SURFBOARD LOCK

[76] Inventor: Dennis MacDonald, 1941 Peke Pl., Kihei, Hi. 96753

[21] Appl. No.: 09/237,098

[22] Filed: Jan. 25, 1999

[51] Int. Cl.[7] ..... E05B 73/00

[52] U.S. Cl. ..... 70/18; 70/58; 248/552

[58] Field of Search ..... 70/18, 58; 248/551–553; 224/917.5

[56] References Cited

U.S. PATENT DOCUMENTS

| | | | |
|---|---|---|---|
| 2,133,883 | 10/1938 | Aubert | 70/58 X |
| 3,242,704 | 3/1966 | Barreca | 70/58 |
| 3,959,995 | 6/1976 | Fletcher | 70/18 |
| 4,003,228 | 1/1977 | Lievens et al. | 70/18 X |
| 4,057,983 | 11/1977 | Morgan | 70/18 |
| 4,216,665 | 8/1980 | McKelvey | 70/58 |
| 4,526,125 | 7/1985 | Bain, Jr. | 70/18 X |
| 4,896,519 | 1/1990 | Pitts | 70/18 X |
| 5,076,531 | 12/1991 | Delaney | 70/58 X |
| 5,095,722 | 3/1992 | Chapmond et al. | 70/18 |
| 5,119,980 | 6/1992 | Grim et al. | 70/18 X |
| 5,675,999 | 10/1997 | Carlstrom | 70/18 |

*Primary Examiner*—Lloyd A. Gall
*Attorney, Agent, or Firm*—Michael I. Kroll

[57] ABSTRACT

The present invention 10 discloses a device used as a security locking device for surfboards 12. The present invention discloses a U-shaped member 14 having parallel leg members which effectively encircle the surfboard 12 with the leg members being slightly wider than the thickness of a surfboard and slightly longer than the width of a surfboard which operates by sliding a surfboard 12 into and between the parallel legs of the U-shaped member 14 and thereafter, placing a locking member 30 that connects the two parallel legs of the device about the surfboard 12. There is also a cable member 24 which can be used to then attach the locking member 30 to any object or structure which will thereby prevent movement of the surfboard 12 beyond the length of the cable 24. The locking mechanism 30 of the present invention 10 has two pivotal leg members 32 which when rotated to the operative position 40 form divergent leg members thereby serving as a security locking upstanding rack device for said surfboard 12 when using one or more of said devices 10 in conjunction with the cable member 32.

8 Claims, 14 Drawing Sheets

SURFBOARD LOCK

BACKGROUND OF THE INVENTION

1. Field of the Invention

The present invention relates generally to surfboard devices and, more specifically, to a security locking device comprising a u-shaped member and a locking member which slides over the open end of said u-shaped member and a cable member which can be attached to any object or structure preventing the movement of said surfboard beyond the length of said cable member and said locking member having two pivotal leg members which when rotated to the operative position form opposed divergent leg members being basically parallel to said u-shaped device, thereby serving as a security locking rack device for said surfboard when using one or more of said devices in conjunction with said cable member.

Another embodiment is provided having a substantially oval shaped rod member having two closely spaced bar members extending transversely to a second substantially oval shaped rod member having a space between said bar members wherein the fin of a surfboard shall reside thereby preventing access and removal of the securement means for removable fin assemblies.

Still another embodiment is provided having a substantially oval shaped rod member having a break in said oval wherein each end of said break forms a closely spaced eyelet thereby allowing said member to be inserted over the end of the surfboard passing the centrally located fin member and having a cable member which can be looped or threaded through or around any object or structure and having an eyelet on each distal end which will be passed over said oval eyelets and said oval eyelets will be secured by any means incorporating a padlock.

2. Description of the Prior Art

There are other locking devices designed to prevent theft of surfboards. Typical of these is U.S. Pat. No. 5,706,680 issued to Wroble on Jan. 13, 1998.

Another patent was issued to Bolich on Dec. 10, 1996 as U.S. Pat. No. 5,582,044. Yet another U.S. Pat. No. 5,531,622 was issued to Nealy on Jul. 2, 1996 and still yet another was issued on Jul. 1, 1997 to Craig as U.S. Pat. No. 5,643,028.

U.S. Pat. No. 5,706,680

Inventor: Ronald G. Wroble

Issued: Jan. 13, 1998

Locking devices for surfboards, sailboards, and skateboards which clamp about tapered sides of surfboards and sailboards adjacent the fins. The devices clamp about skateboard sides between the two sets of wheels. One version has a hook ended rod that grips about a board side and another end that attaches by a padlock to a second rod which hooks about another board side. The first rod end has through holes that insert into a cylinder end of the second rod. The further one rod is inserted into the second cylindrical rod end, the closer the spacing between the hooks. A padlock in the through-holes connect the rods. Another version has a padlock in the second cylindrical rod where grooves on the first rod end are locked in place. Another version has a perpendicular extension bracket that wraps about one surfboard or sailboard fin. Another version uses a top flat plate that hingedly connects to a curved bottom plate. Opposite ends of the plates have matching through-holes for a padlock.

Another version has side-by-side holes in both plates to accommodate different board widths. A cable connects the devices to a pole or bike rack.

U.S. Pat. No. 5,582,044

Inventor: Gary Bolich

Issued: Dec. 10, 1996

A method of locking a surfboard to a roof rack crossbar using a series of adjustable mount block assemblies (10*a–b*) affixed to the rack crossbars (13) at a lateral position of contact with the sides of a surfboard (15*a–b*) placed horizontally on top of the crossbars. The mount block assemblies utilize a metal clamp (12) that is vertically adjusted to the thickness of the surfboard at the lateral position of contact. An internal axle (14) connects two side cams (10*b*) vertically adjacent to a center mount block (10*a*) with clamp (12) affixed within the side cams. Axle (14) allows for the clamp assemblies to open and close by means of rotation of the side cams relative to the position of the mount block. The mount block assemblies utilize a lock pin (16*a–b*) that inserts through an alignment of holes in the mount block assembly to a position of engagement with a cam lock assembly (22*a–f*). Utility of the cam lock serves to prevent or allow removal of the lock pin. This clamping method prevents movement of a surfboard on the crossbar and deters theft.

U.S. Pat. No. 5,531,622

Inventor: Robert B. Nealy

Issued: Jul. 2, 1996

A quick disconnect leash for a surfboard or the like consists of a resilient cord affixed at one end to an object such as a surfboard and a securing strap attached to the opposite end for securing the leash to the ankle or waist of a user. The securing strap is closed by a quick release mechanism consisting of a fastener having opposed locking members for securing the ends of the strap and a quick release assembly for rapidly and conveniently releasing the fastener to free the ends of the strap. The quick release mechanism consists of a connector for acting on the fastener and a upstanding pull for actuating the connector. Preferably the fastener is of the side release type consisting of a housing and clip which is received in the housing to lock the two members together. The fastener is released by pulling the pull to cause the connector to unlock the clip from the housing. The pull should be of sufficient size to be readily grasped, even under emergency conditions. The ring is of sufficient stiffness to carry the pull in the generally upright position, while at the same time is sufficiently resilient so that the pull can be readily moved aside in the event of contact with another object so that the fastener is not accidentally released.

U.S. Pat. No. 5,643,028

Inventor: James J. Craig

Issued: Jul. 1, 1997

A surfboard leash assembly includes an ankle band and an elongate flexible cord having a first end releasably attachable to the ankle band and an opposite second end attachable to a surfboard. A lock mechanism on the ankle band includes a foot actuated switch operable between a locked position to maintain the first end of the cord attached to the ankle band and at least one unlocked position to release the first end of the cord so that, when under tension, the cord disconnects from the ankle band.

While these surfboard locking devices may be suitable for the purposes for which they were designed, they would not be as suitable for the purposes of the present invention, as hereinafter described.

SUMMARY OF THE INVENTION

The present invention discloses a device used as a security locking device for surfboards. The present invention discloses a U-shaped member having parallel leg members which effectively encircle the surfboard with the leg members being slightly wider than the thickness of a surfboard and slightly longer than the width of a surfboard which operates by sliding a surfboard into and between the parallel legs of the U-shaped member and thereafter, placing a locking member that connects the two parallel legs of the device about the surfboard. There is also a cable member which can be used to then attach the locking member to any object or structure which will thereby prevent movement of the surfboard beyond the length of the cable. The locking mechanism of the present invention has two pivotal leg members which when rotated to the operative position form divergent leg members thereby serving as a security locking upstanding rack device for said surfboard when using one or more of said devices in conjunction with the cable member. An alternative embodiment is provided which is composed of two closely spaced bar members being a front and a rear bar member connected together by a two-piece U-shaped flat plate whereby the U-shaped flat plate slides around and over the fin of the surfboard and thereafter is connected together with a combination lock or other type of padlock. Another embodiment is provided having an effectively surfboard encircling rod member having a break therein wherein each end of said break forms a closely spaced eyelet thereby allowing said member to be inserted over the end of the surfboard passing by the centrally located fin member and is thereafter locked with a combination lock or other padlock.

A primary object of the present invention is to provide an economical security device to deter the theft of surfboards.

Another object of the present invention is to provide a security device having one or more u-shaped members, transversal locking member(s) and a length of cable having eyelets on each distal end which will be slipped onto said u-shaped member after said cable has been looped or threaded through or around a preselected securement prior to inserting said locking member(s).

Yet another object of the present invention is to provide a security device having rotatable leg members attached to the locking member which when extended to the operative position forms divergent leg members allowing said security device to act as a rack for said surfboard.

Still yet another object of the present invention is to provide an alternate embodiment that will slide onto a surfboard having transversal bar members to prevent the removal of fin securement means.

Another object of the present invention is to provide still another embodiment of the present invention that can be slid onto the end of the board past the centrally located fin and secured by a padlock.

Yet another object of the present invention is to provide all embodiments with a length of steel cable that can be looped or threaded through or around a predetermined securement and attached to said security devices.

Additional objects of the present invention will appear as the description proceeds.

The present invention overcomes the shortcomings of the prior art by providing a security device which can be attached to a surfboard and having a length of steel cable that can be looped through or around and attached to said security device and wherein said security device can be closed by any means incorporating a padlock.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
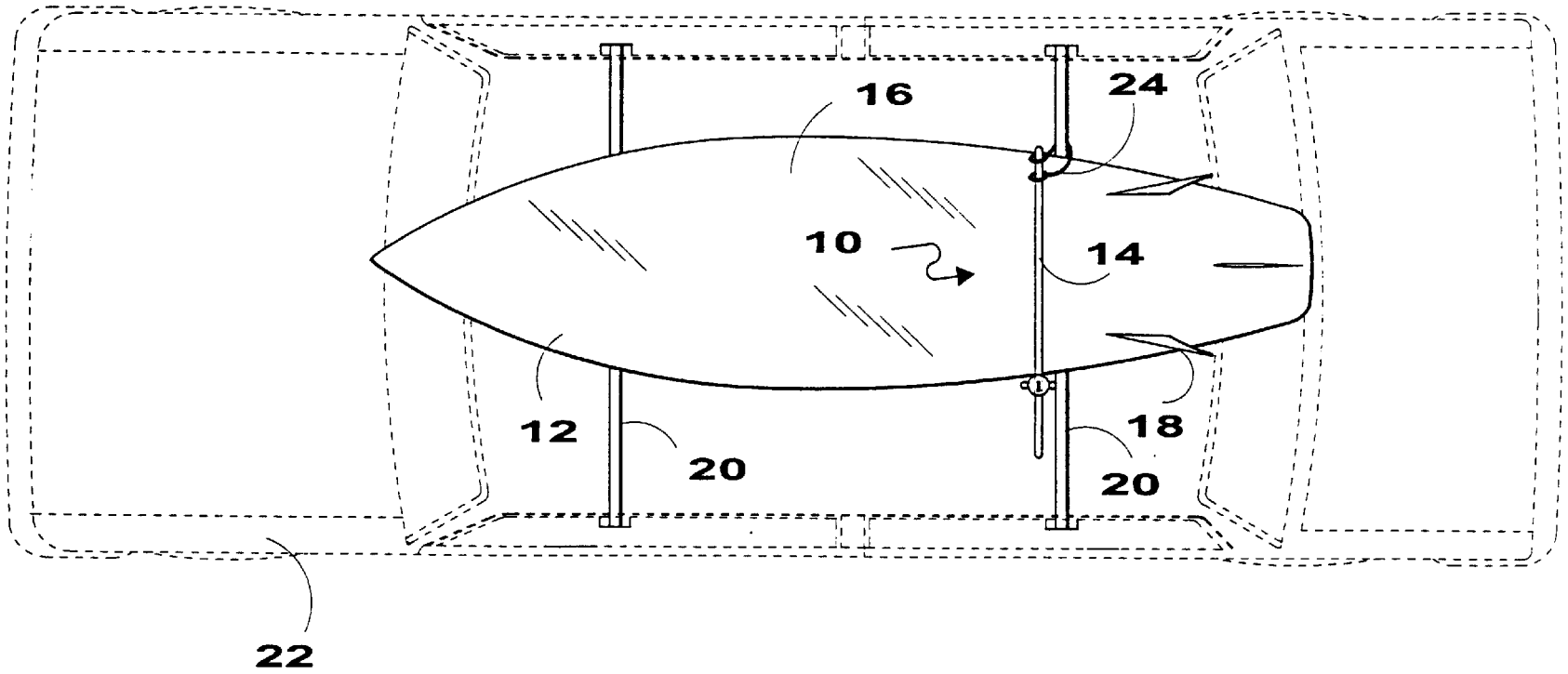
FIG. 1 is a top plan view of the preferred embodiment in use, shown is a surfboard having a u-shaped member placed between the widest part of the surfboard and the fin members thereby securing said surfboard to the rack of a vehicle using a length of steel cable.

With regard to the reference numerals used, the following numbering is used throughout the various figures.

10 present invention
12 surfboard
14 U-shaped member
16 widest part of board
18 fins
20 roof rack
21 handle
22 automobile
23 cable
24 cable
25 malibu surfboard
26 thruster surfboard
27 beginners surfboard
28 ground
29 cable connection means
30 locking member
31 key hole
32 legs
33 leg stops
34 notches
36 leg stop
38 non-operative position
40 operative position
42 tree
44 combination lock
46 front bar member
48 rear bar member
49 piece of U-shaped plate
50 U-shaped plate assembly
51 piece of U-shaped plate
52 eyes for lock
54 connecting plate assembly
56 bar member
58 padlock
60 weld
62 weld
64 nut and bolt
66 fin removal screws
68 mating piece
70 mating piece
72 weld
74 weld

DESCRIPTION OF THE PREFERRED EMBODIMENT(S)

Turning now descriptively to the drawings, in which similar reference characters denote similar elements throughout the several views, FIGS. 1 through 13 illustrate the present invention being a security device for surfboards.

Turning to FIG. 1, therein is shown the preferred embodiment of the present invention 10 shown in use. Shown therein is a surfboard 12 having a U-shaped member 14 which effectively encircles the surfboard 12 placed between the widest 16 part of the surfboard and the narrower fin members 18 at the rear end of the surfboard thereby securing said surfboard 12 to the rack 20 of a vehicle 22 using a length of steel cable 24. It should be understood that the rack 20 is made of two pieces and is secured by attachment means to the roof of the automobile 22.

Figure 1A:
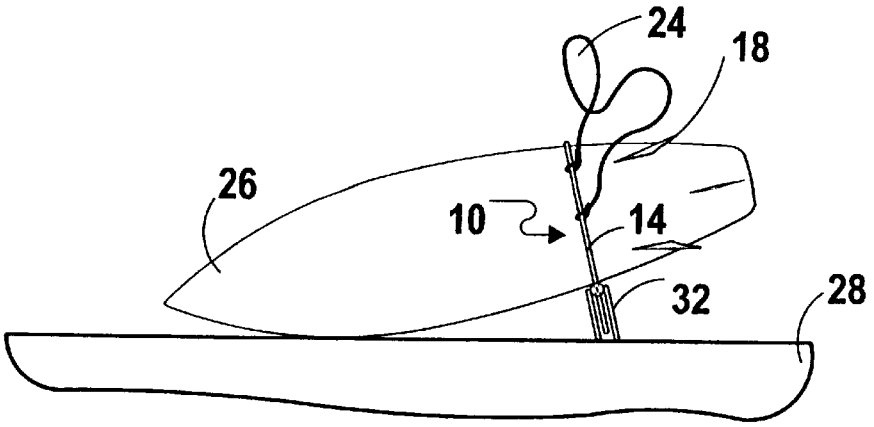
FIG. 1A is a side view of the preferred embodiment of the present invention attached to a thruster surfboard.

Turning to FIG. 1A, therein is shown the preferred embodiment of the present invention 10 attached to a thruster 26 surfboard. Therein is shown the ground 28 along with the U-shaped member 14, the cable 24, the legs 32 stuck in the ground 28 and the fins 18 of the surfboard. Legs 32 are shown sticking in the ground 28 so as to hold the surfboard 26 up on its side in order to keep the surfboard clean and out of contact with the ground.

Figure 1B:
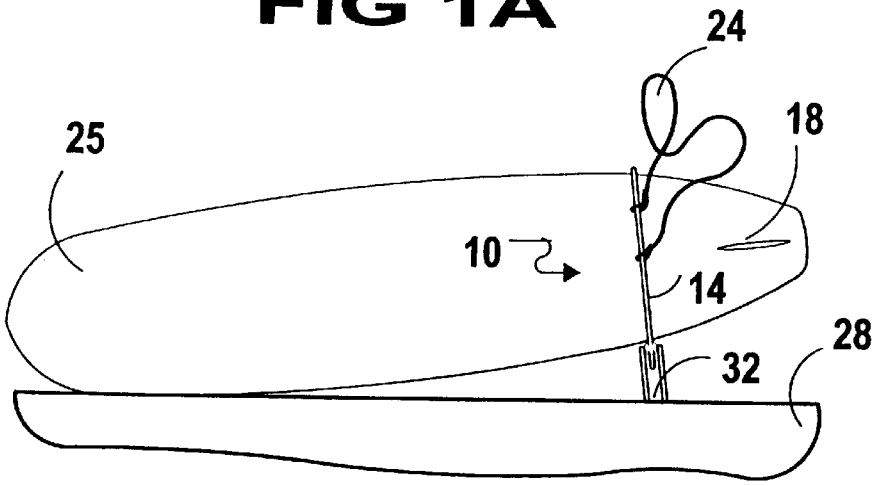
FIG. 1B is a side view of the preferred embodiment of the present invention attached to a malibu surfboard.

Turning to FIG. 1B, therein is shown the preferred embodiment of the present invention 10 attached to a malibu 25 surfboard. Therein is shown the ground 28 along with the U-shaped member 14, the cable 24, the legs 32 stuck in the ground 28 and the fin 18 of the surfboard.

Figure 1C:
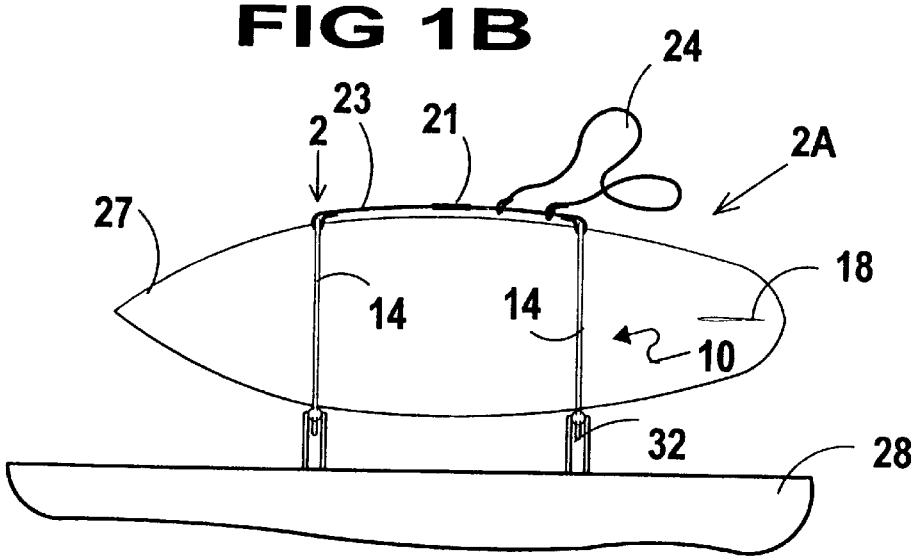
FIG. 1C is a side view of the preferred embodiment of the present invention using two of the security devices attached to the typical beginners surfboard.

Turning to FIG. 1C, therein is shown the preferred embodiment of the present invention 10 attached to a typical beginners 27 surfboard. Therein is shown the ground 28 along with the U-shaped member 14, the cable 24, the legs 32 stuck in the ground 28 and the ends 18 of the surfboard. Therein is shown the use of a second U-shaped member 14 wherein the two U-shaped or dual members 14 are connected to each other by a second flexible cable 23 having an intermediate handle 21 for carrying the surfboard 27. Dual U-shaped members 14 may be used on other types of surfboards also.

Figure 2:
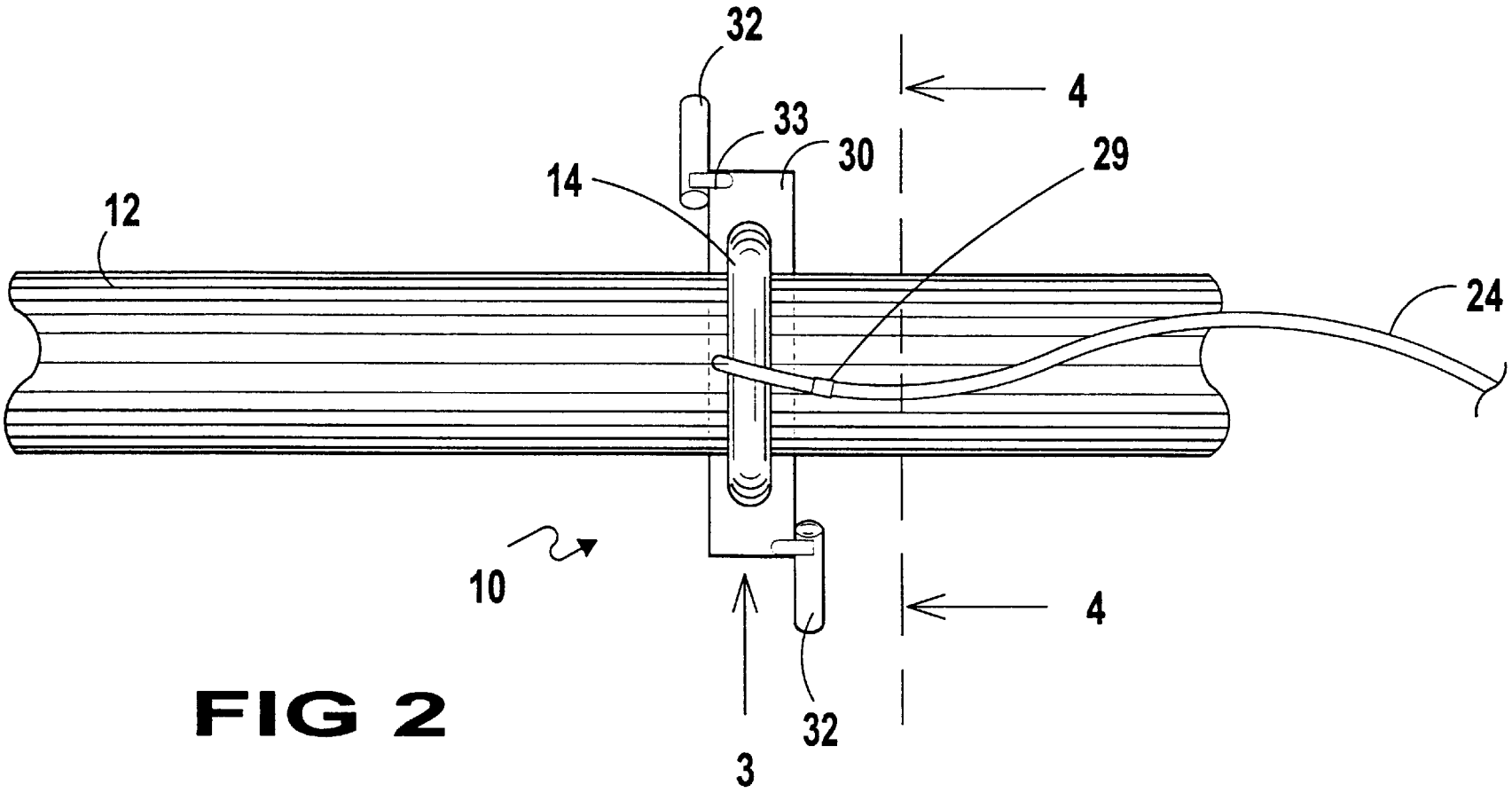
FIG. 2 is a top plan view of the present invention taken from FIG. 1C as indicated showing the u-shaped member and locking member having leg members rotated and extended to their operative position forming divergent leg members.

Turning to FIG. 2, therein is shown the present invention 10 taken from FIG. 1C as indicated, showing the U-shaped member 14 and locking member 30 having leg members 32 rotated and extended to their operative position forming divergent leg members. Also shown therein is the surfboard 12 and the cable 24. The cable 24 is wrapped around the U-shaped member 14 and has means 29 for connecting back to itself. The leg members 32 have stops 33 located on the leg ends so as to abut the locking means 30 and support the leg 32 in its operative positions so that the legs can be stuck into the ground.

Figure 2A:
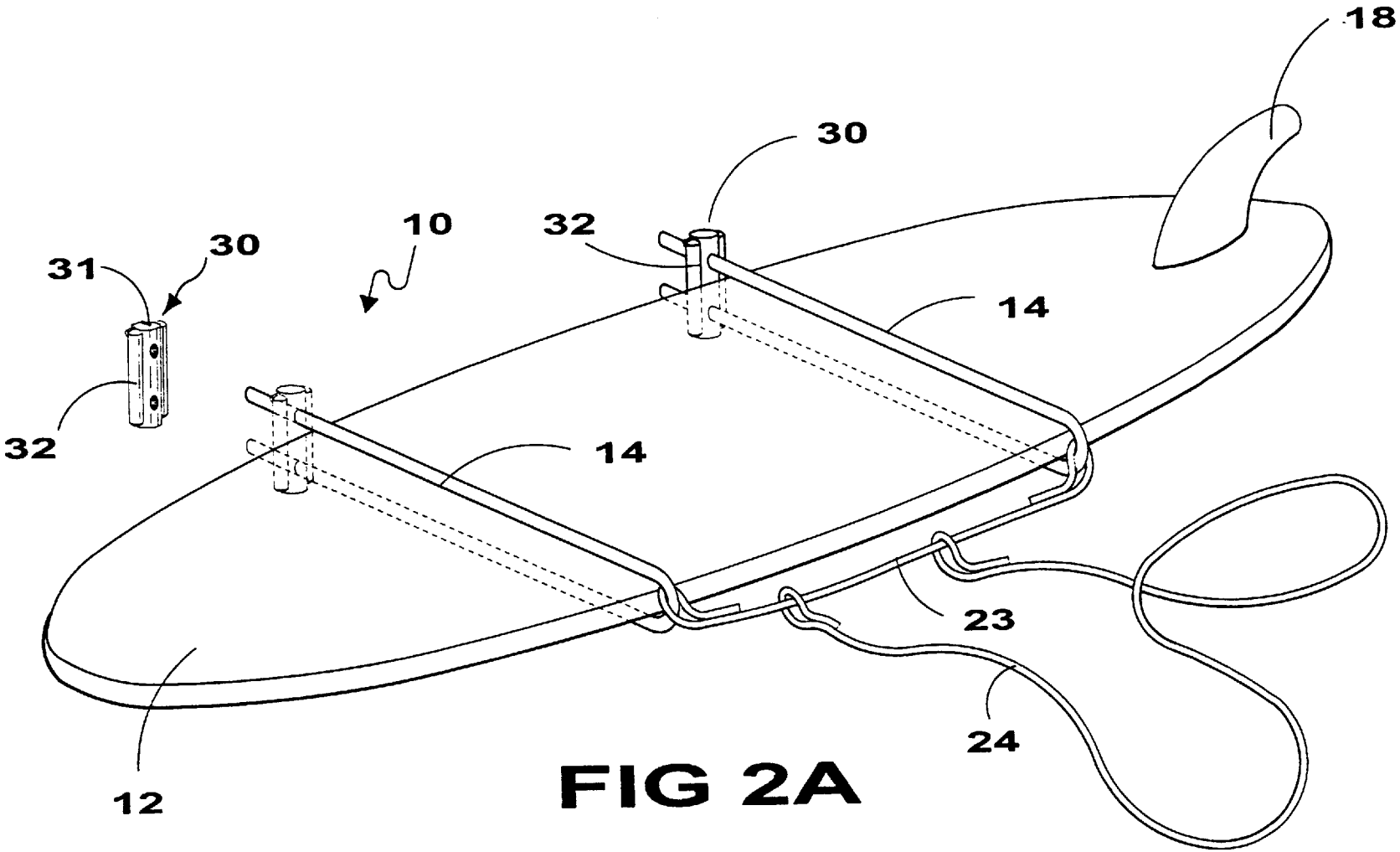
FIG. 2A is a perspective of the present invention shown in operative connection about a surfboard with the legs in the non-operating position.

Turning to FIG. 2A, therein is shown the present invention 10, shown in operative connection about a surfboard 12. Shown are the dual U-shaped members 14, connected to each other by the cable 23, the cable 24, the fin 18, the locking member 30 showing the key hole 31 along with the legs 32 shown in a non-operative position attached thereto. For this non-operative position the legs 32 are rotated to lie parallel to the locking member 30.

Figure 3:
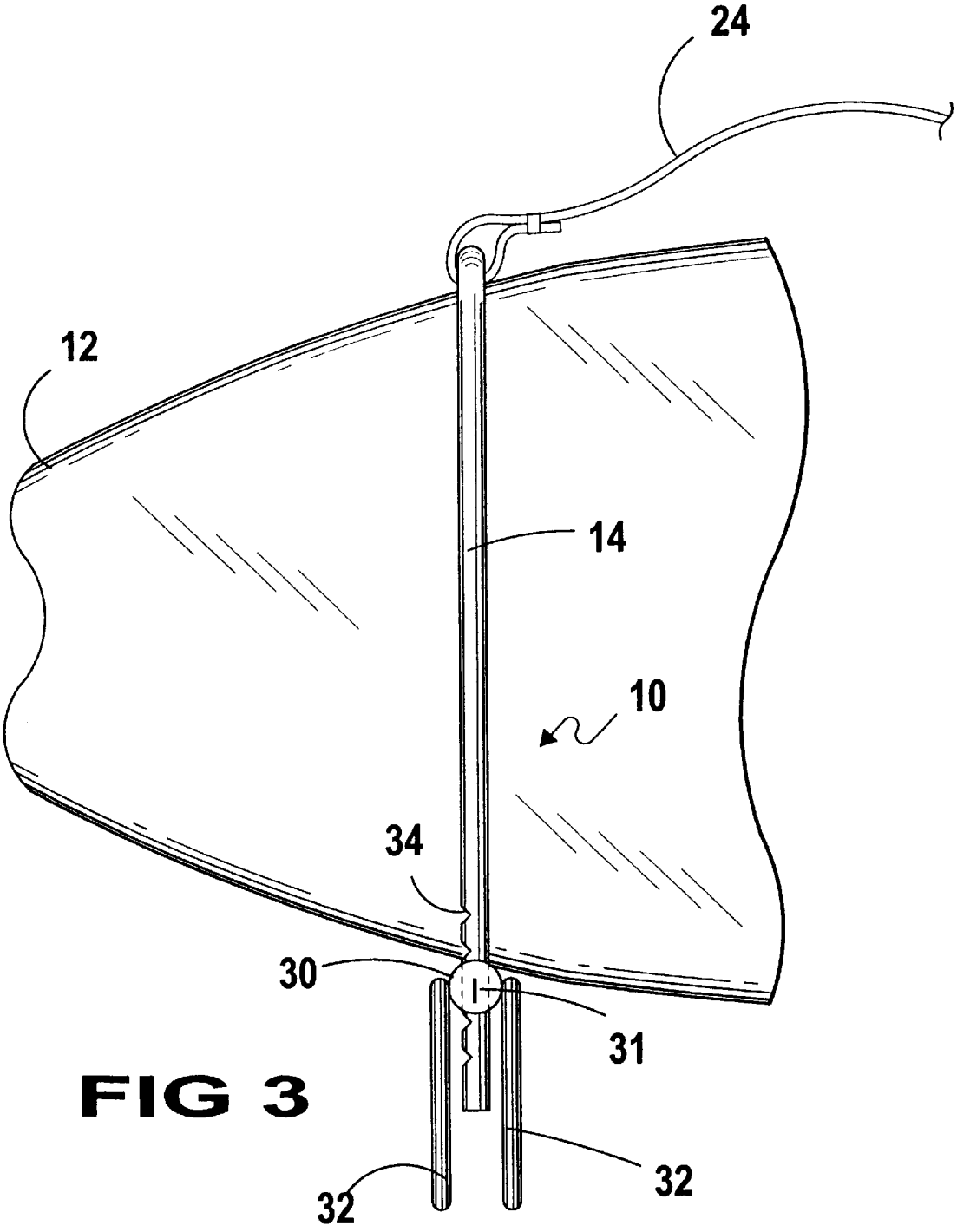
FIG. 3 is a side elevation of the present invention taken from FIG. 1C as indicated showing the u-shaped member and locking member having leg members rotated and extended to their operative position forming divergent leg members.

Turning to FIG. 3, therein is shown the present invention 10 taken from FIG. 1C as indicated, showing the U-shaped member 14 and locking member 30 with key hole 31 and notches 34 having leg members 32 rotated and extended to their operative position forming divergent leg members. Also shown is the surfboard 12 along with the cable 24.

Figure 4:
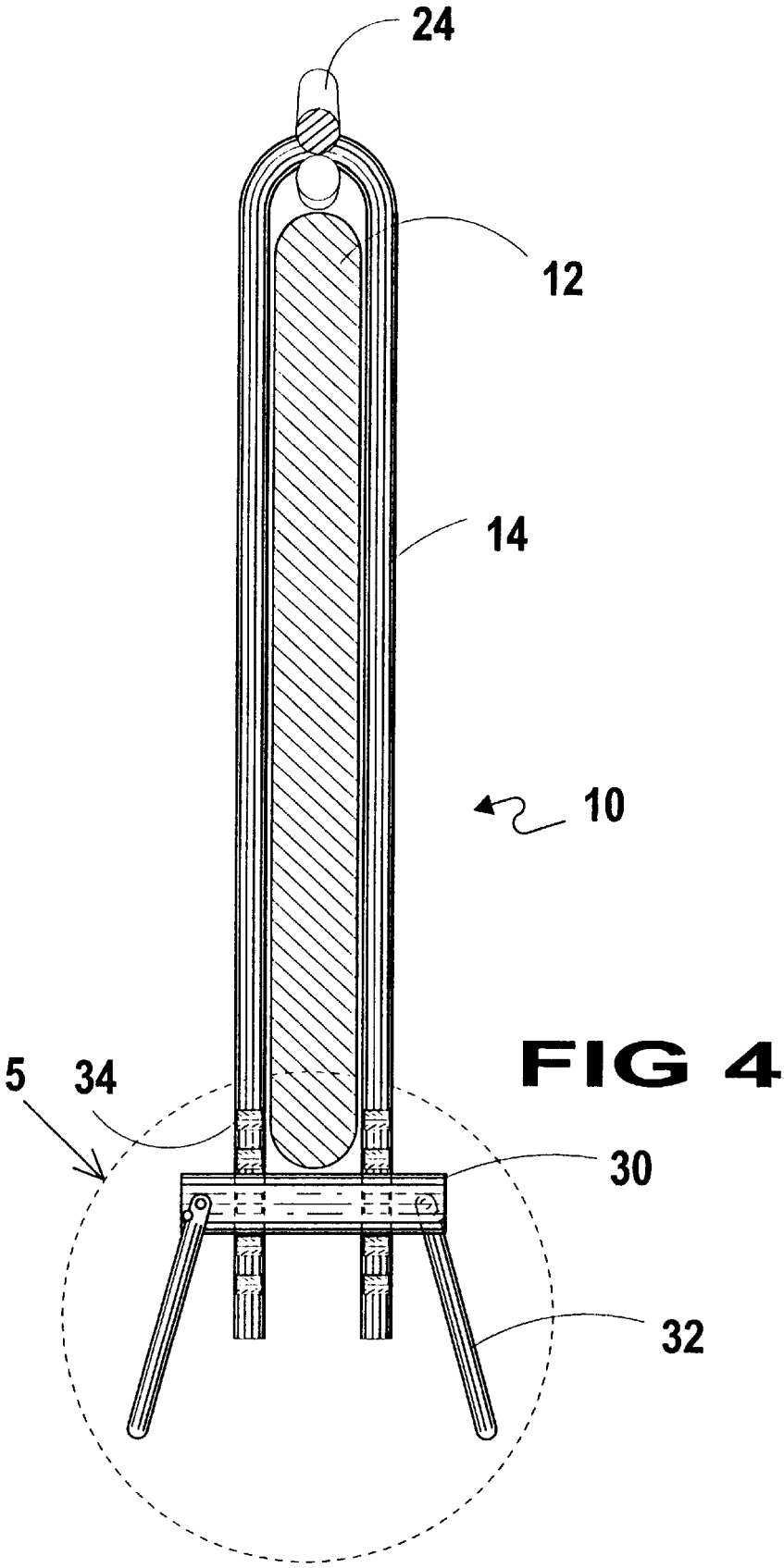
FIG. 4 is a cross sectional view of the present invention taken from FIG. 2 as indicated showing the u-shaped member encompassing the surfboard and having the locking member attached thereon with the rotatable leg members extended to the operative position whereby said security device forms a rack for the enclosed surfboard.

Turning to FIG. 4, therein is shown the present invention 10 taken from FIG. 2 as indicated, showing the U-shaped member 14 encompassing the surfboard 12 and having the locking member 30 attached thereon with the rotatable leg members 32 extended to the operative position whereby said security device forms a standup rack for the enclosed surfboard. Also shown is the cable 24 and notches 34.

Figure 5:
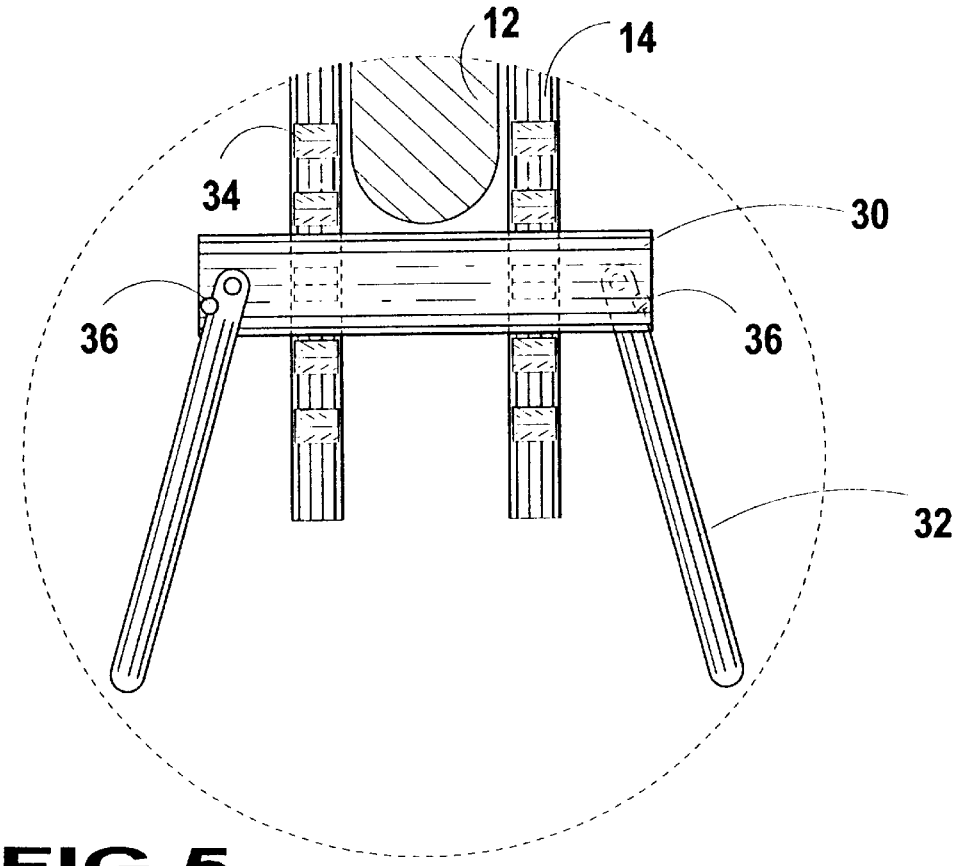
FIG. 5 is a enlarged view of the locking member taken from FIG. 4 as indicated showing the u-shaped member extending through said locking member having rotatable leg members extended to the operative position.

Turning to FIG. 5, therein is shown the locking member 30 taken from FIG. 4 as indicated, showing the U-shaped member 14 extending through said locking member 30 having rotatable leg members 32 extended to the operative position. Also shown is the surfboard 12. Also shown are notches 34 cut into the U-shaped member 14 so as to allow an attaching surface for the locking member 30 to lock to. Also shown is a stop means 36 which forms a stop for the leg 32. The locking member 30 comprises a standard type of locking mechanism, similar to a common commercially available bicycle lock, which is made and operates in the standard manner.

Figure 6:
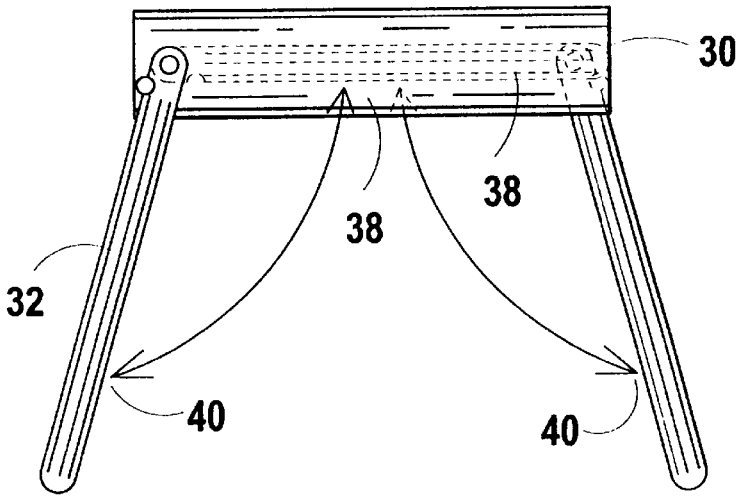
FIG. 6 is an enlarged view of the locking member showing the nonoperative position of the rotatable leg members, shown in outline, and the operative position of the rotatable leg members.

Turning to FIG. 6, therein is shown the locking member 30 showing in outline a non-operative position 38 of the rotatable leg members 32 and the operative position 40 of the rotatable leg members 32.

Figure 7:
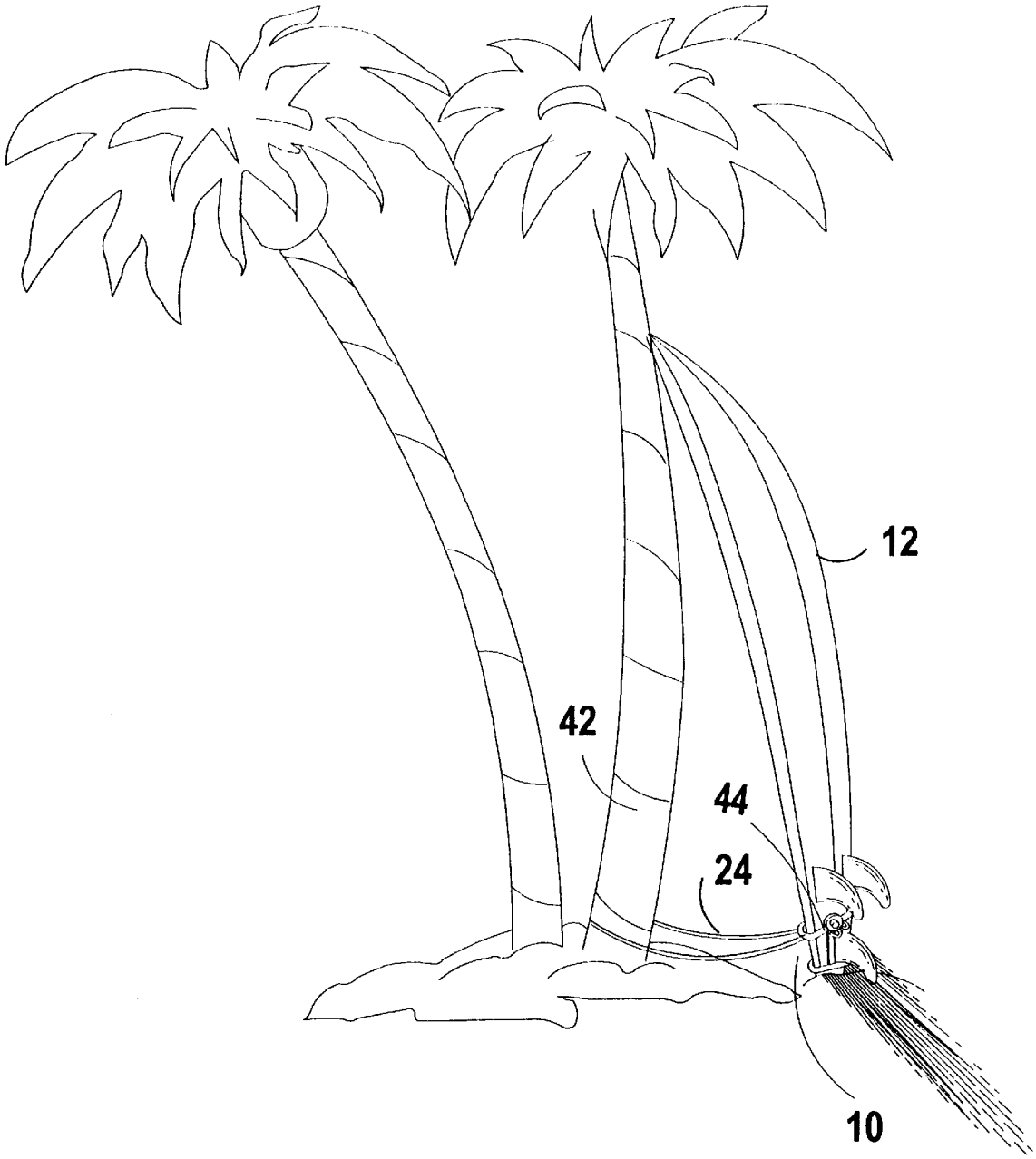
FIG. 7 is a perspective view of an alternate embodiment of the present invention in use. Shown is a surfboard having the security device in place preventing access to the fin removal assembly and having the cable member wrapped around a tree.

Turning to FIG. 7, therein is shown an alternative embodiment of the present invention 10 in use. Shown is a surfboard 12 having the security device 10 in place preventing access to the fin removal assembly and having the cable 24 wrapped around a tree 42 so that the surfboard cannot be removed. Also shown is a combination lock 44 which locks the present invention 10 in place.

Figure 8:
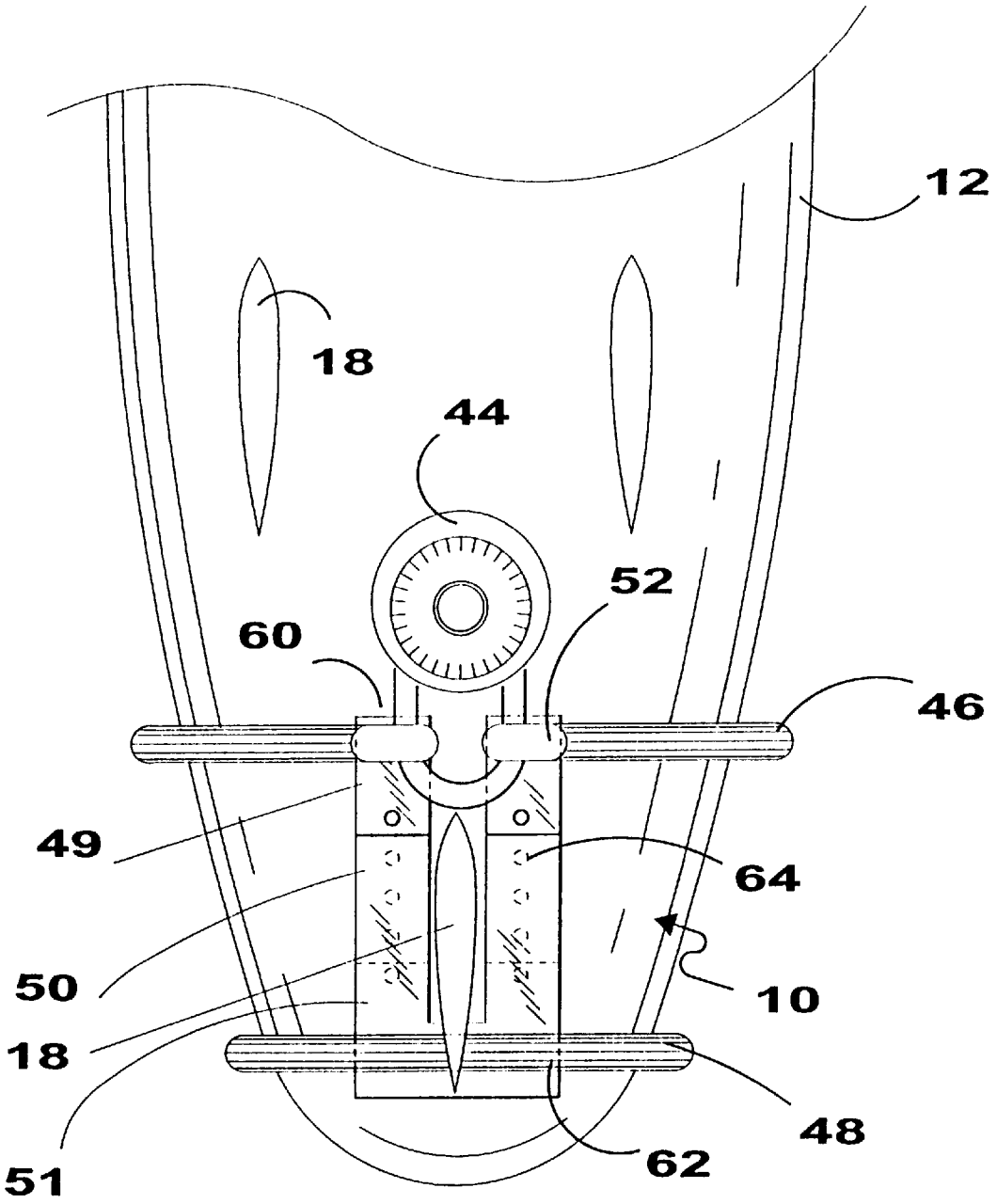
FIG. 8 is an exploded views of the alternate embodiment of the present invention shown in FIG. 7. Shown is a surfboard having the security device in place preventing access to the fin removal assembly.

Turning to FIG. 8, therein is shown the alternative embodiment of the present invention 10 shown in FIG. 7. Shown is a surfboard 12 having a security device 10 in place preventing access to the fin removal assembly (not shown). Shown are the fins 18 of the surfboard having two bar members being a front bar member 46 and a rear bar member 48 which effectively encircle the surfboard 12 which have a U-shaped plate 50 to connect it thereto which U-shaped plate slides around and encompasses the fin 18. The combination lock 44 is then placed into and about the lock eyes 52 of the bar 46 and thereby the security device 10 is secured to the surfboard. The U-shaped plate assembly 50 comprises two overlapping mating pieces 49 and 51 which are welded or attached by other means 60, 62 to the bar members 46 and 48. The pieces 49 and 51 have means for connection to each other, e.g., nuts and bolt 64.

Figure 9:
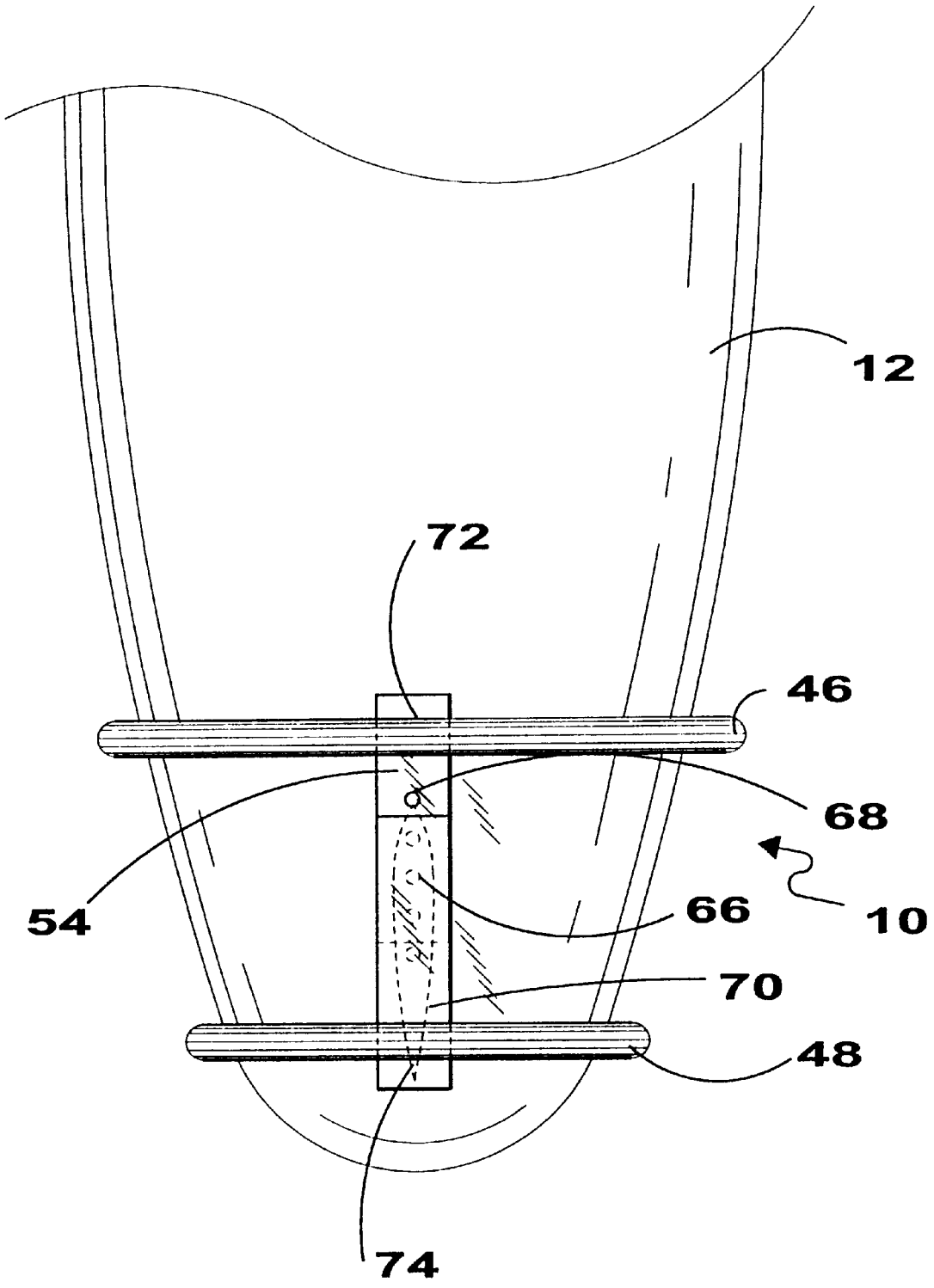
FIG. 9 is a bottom view of the alternate embodiment of the present invention shown in FIG. 8. Shown is a surfboard having the security device in place preventing access to the fin removal assembly.

Turning to FIG. 9, therein is shown the alternative embodiment of the present invention 10 shown in FIG. 8. Shown is a surfboard 12 having a security device 10 preventing access to the fin removal assembly 66. A front bar 46 is shown connected to the rear bar 48 by a flat piece member 54. T he member assembly 54 comprises two overlapping, mating pieces 68 and 70 connected to the front bar 46 by a weld 72 and to the rear bar 48 by a weld 74.

Figure 10:
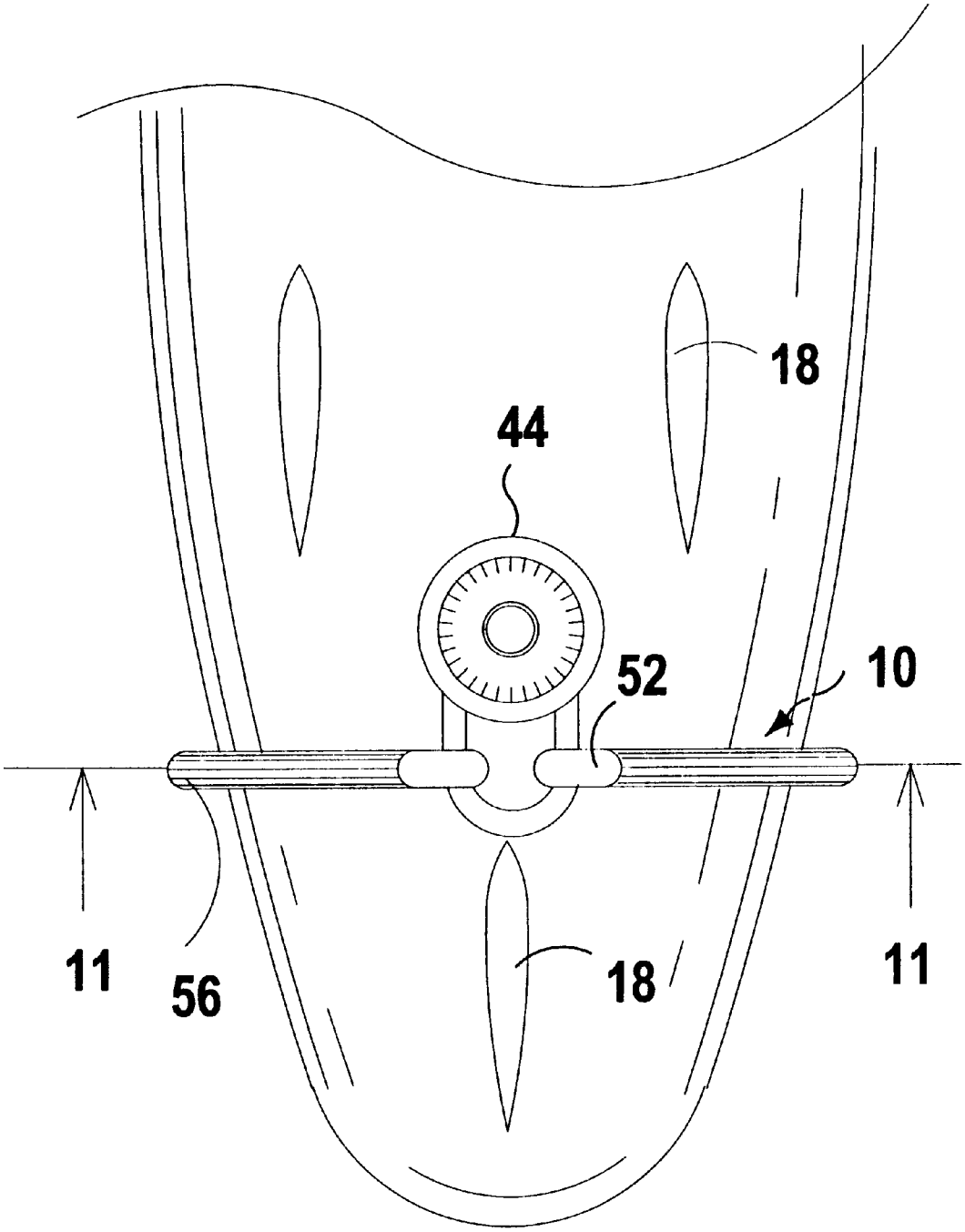
FIG. 10 is a front elevation of an additional embodiment of the present invention showing a single bar member inserted between the fins and secured by means of a padlock.

Turning to FIG. 10, therein is shown an additional embodiment of the present invention 10 showing a single bar member 56 which effectively encircles the surfboard 12 inserted between the fins 18 and secured by means of a padlock 44. The eyes of the bar member are shown at 52.

Figure 11:
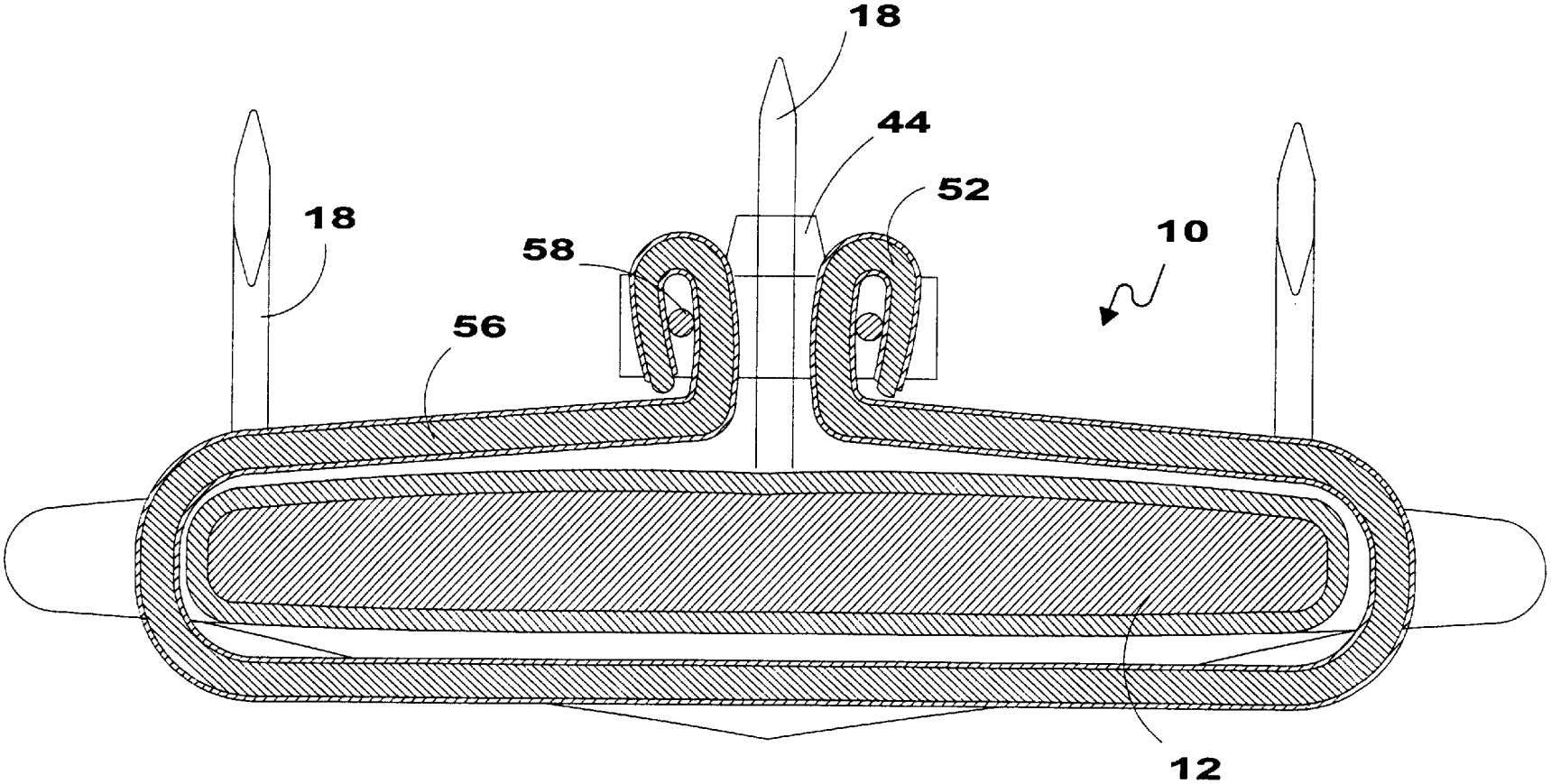
FIG. 11 is a cross section of the additional embodiment of the present invention shown in FIG. 10, showing a single bar member inserted between the fins and secured by means of a padlock.

Turning to FIG. 11, therein is shown a cross-sectional view of the additional embodiment of the present invention 10 shown in FIG. 10, showing a single bar member 56 inserted between the fins 18 and secured by means of a padlock 44. The eyes of the bar member 52 are shown with the shackle 58 padlock passing through the eyes 52. Also shown is the surfboard 12.

Figure 12:
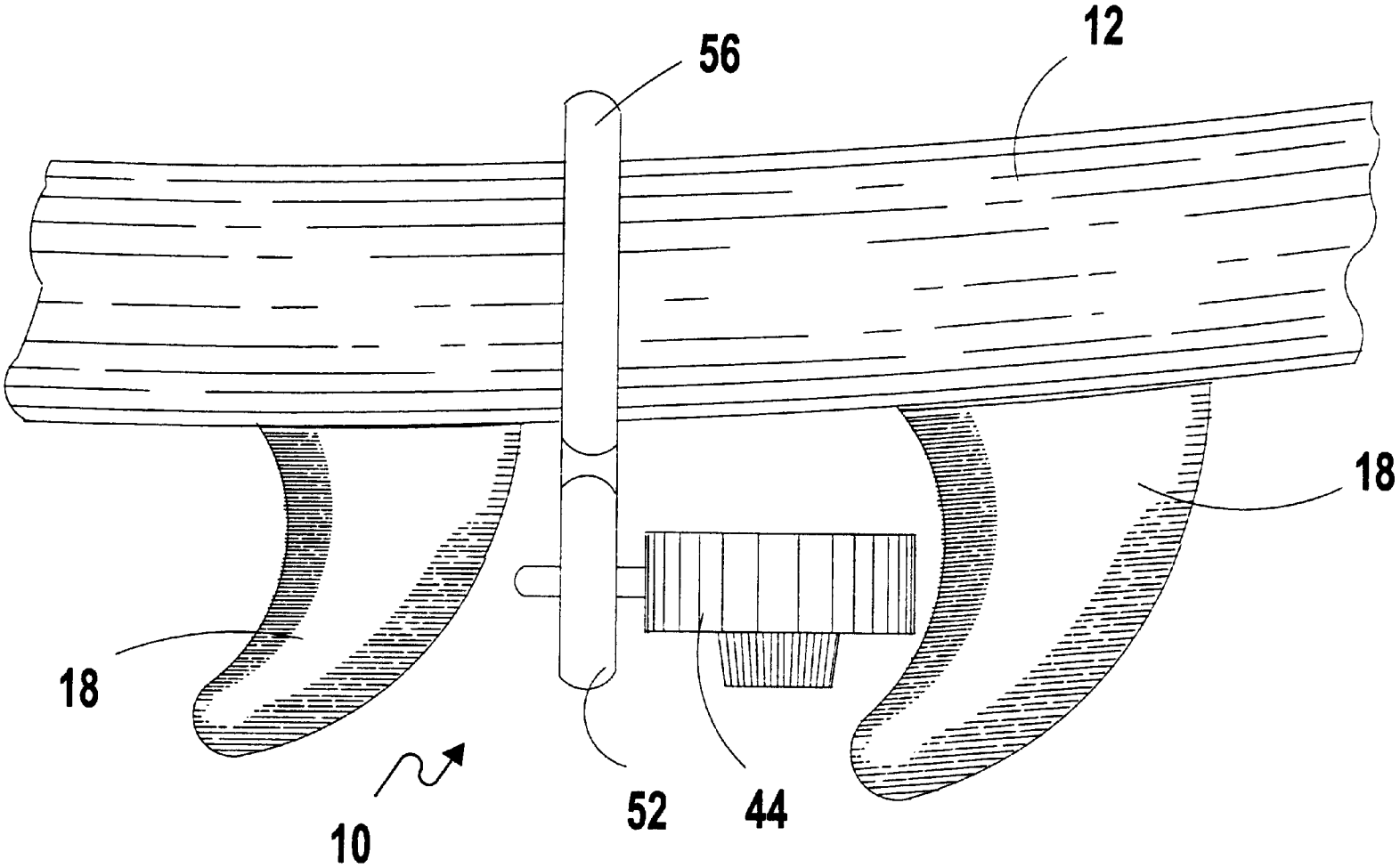
FIG. 12 is a side elevation of the additional embodiment shown in FIG. 10.

Turning to FIG. 12, therein is shown the additional embodiment of the present invention 10 shown in FIG. 10. Shown is the rod member 56 installed between the fins 18 of the surfboard 12 and closed by means of a padlock 44 which passes through the eyes 52 of the rod member 56.

Figure 13:
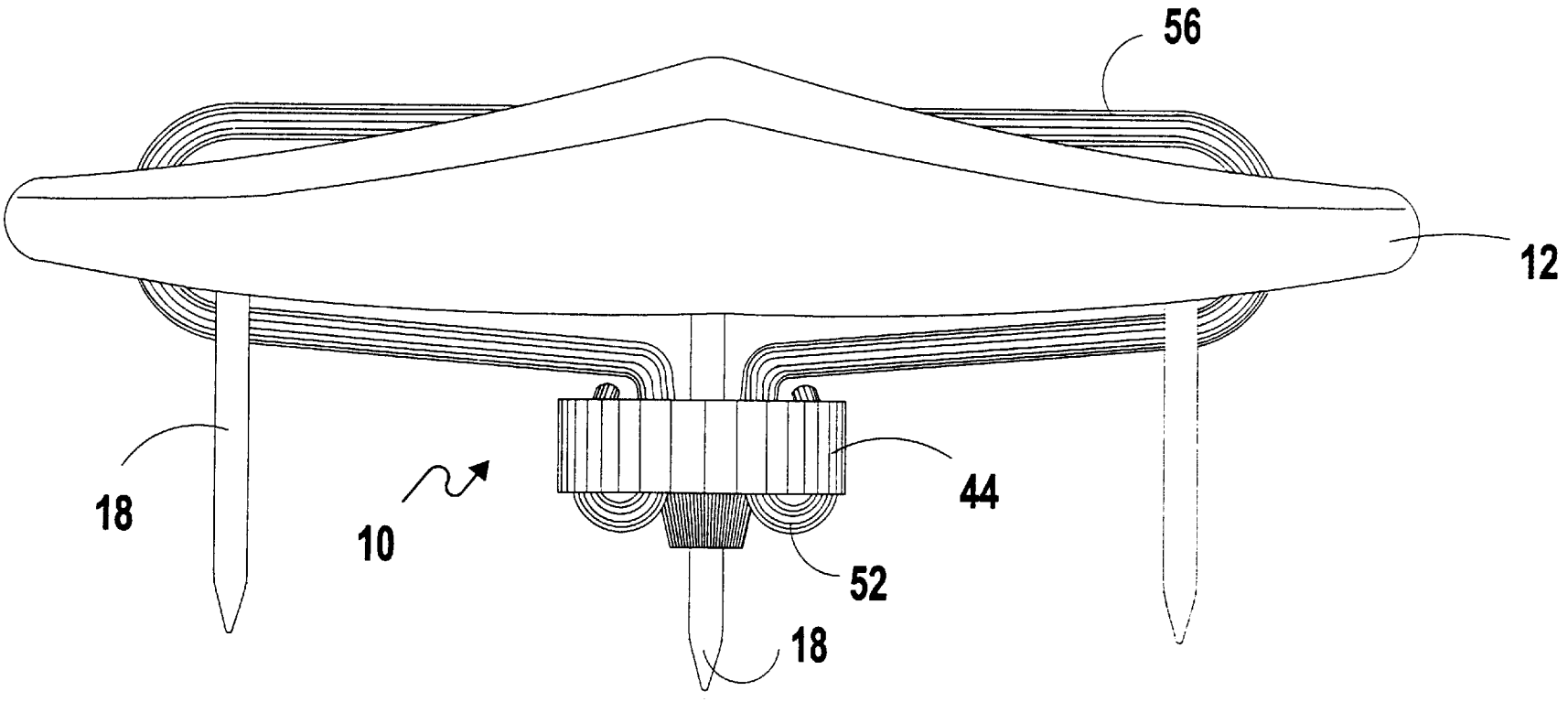
FIG. 13 is a front elevation of the additional embodiment of the present invention shown in FIG. 10 having the bar member installed between the fins of a surfboard.

Turning to FIG. 13, therein is shown the additional embodiment of the present invention 10 shown in FIG. 10, showing a single bar member 56 inserted between the fins 18 and secured by means of a padlock 44. Also shown is the surfboard 12.

What is claimed is:

1. An apparatus for securing, and in combination with, a surfboard, comprising:

a) a U-shaped member having parallel leg members encircling said surfboard, said leg members having free ends with notches thereon;

b) said U-shaped member having a locking mechanism engaging the notches on the free ends of said leg members for locking onto said U-shaped member;

c) means for attaching said U-shaped member to the roof rack of an automobile for securing the surfboard to the roof rack of the automobile; and d) said locking mechanism comprising a block shaped member with two spaced openings extending between first and second opposite side wall portions of said block shaped member for accommodating the free ends of said U-shaped member, a locking means within said block shaped member for locking said block shaped member on said free ends, and a pair of movable legs, each leg pivoted at one end on third and fourth side wall portions, respectively, of said block shaped member, said legs when retracted being flush against the respective third and fourth side wall portions of said block shaped member and when deployed form a pair of legs adapted to being used for raising an end of said surfboard above a ground surface when said surfboard is positioned on the ground surface.

2. The apparatus of claim 1, said means for attaching said U-shaped member to the roof rack of an automobile further comprising a cable.

3. The apparatus of claim 1, having two U-shaped members.

4. The apparatus of claim 3, said U-shaped members further comprising means for attachment to each other.

5. The apparatus of claim 4, said means for attachment further comprising a carrying handle.

6. The apparatus of claim 1, said leg members being slightly further apart than the thickness of the surfboard.

7. The apparatus of claim 6, said U-shaped member and said locking mechanism forming an assembly slightly wider than the surfboard whereby said surfboard is effectively encircled.

8. The apparatus of claim 7, said assembly being attached between the widest point of the surfboard and a fin of the surfboard whereby said surfboard is secured.

* * * * *